US008262372B2

(12) United States Patent
Wang et al.

(10) Patent No.: US 8,262,372 B2
(45) Date of Patent: Sep. 11, 2012

(54) COMPRESSOR HERMETIC TERMINAL

(75) Inventors: Zhichao Wang, Vandalia, OH (US); David E. Ayton, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 972 days.

(21) Appl. No.: 12/115,651

(22) Filed: May 6, 2008

(65) Prior Publication Data

US 2008/0279703 A1 Nov. 13, 2008

Related U.S. Application Data

(60) Provisional application No. 60/928,677, filed on May 10, 2007.

(51) Int. Cl.
*F04B 17/00* (2006.01)
*B21D 39/00* (2006.01)

(52) U.S. Cl. ..... 417/410.1; 228/164

(58) Field of Classification Search ..... 417/410.1; 29/888.02; 228/164–174
See application file for complete search history.

(56) References Cited

U.S. PATENT DOCUMENTS

| | | | |
|---|---|---|---|
| 1,658,861 | A | 2/1928 | Martin |
| 1,658,862 | A | 2/1928 | Slade |
| 2,205,051 | A | 6/1940 | Schmitt |
| 2,658,185 | A | 11/1953 | Hatcher |
| 2,728,060 | A | 12/1955 | Doeg |
| 3,016,511 | A | 1/1962 | Unger |
| 3,031,861 | A | 5/1962 | McCormack |
| 3,417,361 | A | 12/1968 | Heller |
| 3,605,076 | A | 9/1971 | Dozier |
| 3,684,819 | A | 8/1972 | Wilson |
| 3,696,321 | A | 10/1972 | Cooper, Jr. |
| 4,059,325 | A | 11/1977 | Diminnie et al. |
| 4,120,555 | A | 10/1978 | Shiflett et al. |
| 4,252,394 | A | 2/1981 | Miller |
| 4,469,923 | A | 9/1984 | Charboneau |
| 4,480,151 | A | 10/1984 | Dozier |
| 4,508,413 | A | 4/1985 | Bailey |
| 4,551,069 | A | 11/1985 | Gilmore |
| 4,712,430 | A | 12/1987 | Wareham |
| 4,743,184 | A | 5/1988 | Sumikawa et al. |
| 4,782,197 | A | 11/1988 | Stunzi et al. |
| 4,840,547 | A | 6/1989 | Fry |
| 4,964,788 | A | 10/1990 | Itameri-Kinter et al. |
| 4,966,559 | A | 10/1990 | Wisner |

(Continued)

FOREIGN PATENT DOCUMENTS

EP 0284633 A1 10/1988

(Continued)

OTHER PUBLICATIONS

International Search Report on Patentability dated Nov. 19, 2009 regarding International Application No. PCT/US2008/005971.

(Continued)

*Primary Examiner* — Charles Freay
(74) *Attorney, Agent, or Firm* — Harness, Dickey & Pierce, P.L.C.

(57) ABSTRACT

A compressor including a shell having an aperture. A drive mechanism is disposed within the shell, and a compression mechanism is driven by the drive mechanism. A hermetic terminal assembly is provided in the aperture including a cup-shaped housing surrounded by an annular flange. The annular flange is secured to an inner surface of the shell a distance away from the aperture.

26 Claims, 5 Drawing Sheets

U.S. PATENT DOCUMENTS

| | | | | |
|---|---|---|---|---|
| 4,984,468 | A | | 1/1991 | Hafner |
| 4,984,973 | A | | 1/1991 | Itameri-Kinter et al. |
| 5,035,653 | A | | 7/1991 | Honkomp et al. |
| 5,121,094 | A | | 6/1992 | Ting et al. |
| 5,134,888 | A | | 8/1992 | Zylka et al. |
| 5,152,672 | A | | 10/1992 | Miyazawa |
| 5,201,673 | A | | 4/1993 | Minezawa et al. |
| 5,219,041 | A | | 6/1993 | Greve |
| 5,252,036 | A | | 10/1993 | Bunch et al. |
| 5,315,878 | A | | 5/1994 | Birenheide |
| 5,471,015 | A | | 11/1995 | Paterek et al. |
| 5,493,073 | A | | 2/1996 | Honkomp |
| 5,503,542 | A | | 4/1996 | Grassbaugh et al. |
| 5,522,267 | A | | 6/1996 | Lewis |
| 5,580,282 | A | | 12/1996 | Paterek |
| 5,584,716 | A | * | 12/1996 | Bergman ..... 439/282 |
| 5,669,763 | A | | 9/1997 | Pryce et al. |
| 5,712,428 | A | | 1/1998 | Schleiferbock |
| 5,750,899 | A | | 5/1998 | Hegner et al. |
| 5,756,899 | A | | 5/1998 | Ugai et al. |
| 5,831,170 | A | | 11/1998 | Sokn |
| 5,872,315 | A | | 2/1999 | Nagase et al. |
| 5,941,730 | A | | 8/1999 | Uchiyama et al. |
| 5,984,645 | A | | 11/1999 | Cummings |
| 6,102,666 | A | | 8/2000 | Albrecht |
| 6,140,592 | A | | 10/2000 | Paterek et al. |
| 6,224,348 | B1 | | 5/2001 | Fukanuma et al. |
| 6,276,901 | B1 | | 8/2001 | Farr et al. |
| 6,332,327 | B1 | | 12/2001 | Street et al. |
| 6,350,630 | B1 | | 2/2002 | Wildgen |
| 6,351,996 | B1 | | 3/2002 | Nasiri et al. |
| 6,361,281 | B1 | | 3/2002 | Wurth et al. |
| 6,372,993 | B1 | | 4/2002 | Eckels et al. |
| 6,375,497 | B1 | | 4/2002 | DiFlora |
| 6,422,830 | B1 | | 7/2002 | Yamada et al. |
| 6,435,017 | B1 | | 8/2002 | Nowicki, Jr. et al. |
| 6,484,585 | B1 | | 11/2002 | Sittler et al. |
| 6,607,367 | B1 | | 8/2003 | Shibamoto et al. |
| 6,716,009 | B2 | | 4/2004 | Sowa et al. |
| 6,752,646 | B2 | | 6/2004 | McCoy |
| 6,755,631 | B2 | | 6/2004 | Kawashima et al. |
| 6,779,989 | B2 | | 8/2004 | Makino et al. |
| 6,866,487 | B2 | | 3/2005 | Abe et al. |
| 6,883,379 | B2 | | 4/2005 | Kaneko et al. |
| 6,910,904 | B2 | | 6/2005 | Herrick et al. |
| 6,923,068 | B2 | | 8/2005 | Barron |
| 6,925,885 | B2 | | 8/2005 | Ishio et al. |
| 7,077,694 | B2 | | 7/2006 | Nakano et al. |
| 7,108,489 | B2 | | 9/2006 | Yap |
| 7,252,005 | B2 | | 8/2007 | Schulman |
| 7,290,989 | B2 | | 11/2007 | Jayanth |
| 7,559,794 | B2 | | 7/2009 | Taguchi et al. |
| 7,866,964 | B2 | | 1/2011 | Jayanth |
| 2002/0081899 | A1 | | 6/2002 | Korber |
| 2002/0127120 | A1 | | 9/2002 | Hahn et al. |
| 2002/0182935 | A1 | | 12/2002 | Monde et al. |
| 2004/0020299 | A1 | | 2/2004 | Freakes et al. |
| 2004/0118146 | A1 | | 6/2004 | Haller et al. |
| 2005/0028585 | A1 | | 2/2005 | Matsumura et al. |
| 2005/0028596 | A1 | | 2/2005 | Gall |
| 2005/0217383 | A1 | | 10/2005 | Tohyama et al. |
| 2006/0013697 | A1 | | 1/2006 | Uratani |
| 2006/0068626 | A1 | | 3/2006 | Hasegawa |
| 2006/0141838 | A1 | | 6/2006 | Kertesz |
| 2006/0144153 | A1 | | 7/2006 | Brosh |
| 2006/0275143 | A1 | | 12/2006 | Jayanth |
| 2007/0184697 | A1 | | 8/2007 | Taguchi et al. |
| 2009/0060749 | A1 | | 3/2009 | Hoying et al. |

FOREIGN PATENT DOCUMENTS

| | | | |
|---|---|---|---|
| EP | 0 677 727 | A2 | 10/1995 |
| EP | 1020646 | A1 | 7/2000 |
| JP | 02104995 | | 4/1990 |
| JP | 09032775 | A | 2/1997 |
| JP | 2001-116638 | A | 4/2001 |
| JP | 2006097557 | | 4/2006 |
| WO | 2006013872 | A1 | 2/2006 |

OTHER PUBLICATIONS

Written Opinion of the International Searching Authority dated Sep. 30, 2008 regarding International Application No. PCT/US2008/005971.

International Search Report dated Sep. 30, 2008 regarding International Application No. PCT/US2008/005971.

Advisory Action Before the Filing of an Appeal Brief dated Oct. 24, 2008 regarding U.S. Appl. No. 11/134,130.

Office Action Summary dated Jul. 9, 2008 regarding U.S. Appl. No. 11/134,130.

Office Action Summary dated Dec. 21, 2007 regarding U.S. Appl. No. 11/134,130.

Office Action Summary dated Aug. 13, 2007 regarding U.S. Appl. No. 11/134,130.

Office Action Summary dated Feb. 23, 2007 regarding U.S. Appl. No. 12/134,130.

First Office Action regarding Chinese Patent Application No. 200880015473.1, dated May 23, 2011. English translation provided by Unitalen Attorneys at Law.

Chinese Office Action dated Nov. 28, 2008, and English translation of the Chinese Office Action entitled "Text Portion of the First Office Action" provided by CCPIT Patent and Trademark Law Office on Dec. 18, 2008.

Summary of the Second Office Action received from the Mexican Institute of Industrial Property (IMPI) regarding Application No. PA/a/2006/005167. Summary provided by Goodrich, Riquelme y Asociados on Mar. 20, 2009.

Summary of the Third Office Action received from the Mexican Institute of Industrial Property (IMPI) regarding Application No. PA/a/2006/005167. Summary provided by Goodrich, Riquelme y Asociados on Sep. 3, 2009.

Partial European Search Report dated Sep. 2, 2009 regarding Application No. EP05256767.

Chinese Second Office Action dated Jan. 8, 2010 and issued in connection with a corresponding Chinese Application. Translation prepared by Unitalen Attorneys at Law. cited by other.

Summary of the Fourth Office Action received from the Mexican Institute of Industrial Property (IMPI) regarding Application No. PA/a/2006/005167. Summary provided by Goodrich, Riquelme y Asociados on Mar. 25, 2010.

International Preliminary Report on Patentability regarding International Application No. PCT/US2008/010228 dated Mar. 2, 2010.

First Office Action regarding Chinese Patent Application No. 200880104495.5, dated Apr. 19, 2011. English translation provided by Unitalen Attorneys at Law.

Non-Final Office Action for U.S. Appl. No. 12/199,467, dated Jul. 29, 2011.

Final Office Action for U.S. Appl. No. 12/199,467, dated Jan. 18, 2012.

Non-Final Office Action for U.S. Appl. No. 11/134,130, dated Jun. 18, 2010.

Final Office Action for U.S. Appl. No. 11/134,130, dated Mar. 9, 2010.

Non-Final Office Action for U.S. Appl. No. 11/134,130, dated Oct. 23, 2009.

Final Office Action for U.S. Appl. No. 11/134,130, dated May 14, 2009.

Non-Final Office Action for U.S. Appl. No. 11/134,130, dated Dec. 19, 2008.

International Search Report regarding Application No. PCT/US2010/028667, mailed Oct. 28, 2010.

International Search Report regarding International Application No. PCT/US2008/010228 dated Feb. 3, 2009.

Written Opinion of the International Searching Authority regarding Application No. PCT/US2010/028667, mailed. Oct. 28, 2010.

Written Opinion of the International Searching Authority regarding International Application No. PCT/US2008/010228 dated Feb. 3, 2009.

* cited by examiner

COMPRESSOR HERMETIC TERMINAL

CROSS-REFERENCE TO RELATED APPLICATIONS

This application claims the benefit of U.S. Provisional Application No. 60/928,677, filed on May 10, 2007. The disclosure of the above application is incorporated herein by reference.

FIELD

The present disclosure relates to a hermetic terminal for a compressor.

BACKGROUND

The statements in this section merely provide background information related to the present disclosure and may not constitute prior art.

Hermetic terminals may be used to provide an electrical connection between electrical components in the interior of a compressor and an exterior power supply or other external electrical device. Hermetic terminals are generally provided in an aperture on the compressor shell.

During operation of the compressor, pressures within the shell fluctuate. Fluctuation in pressure may cause the shell to expand and contract. This expansion and contraction cycle may introduce a localized bending cycle around the terminals. Continuation of this bending cycle may cause a fatigue failure in the wall of the terminal or in the joint between the terminal and the aperture. This failure may lead to loss of the hermetic seal and compressor failure.

SUMMARY

The present disclosure provides a compressor including a shell having an inner surface and an outer surface. An aperture is provided in the shell, a drive mechanism is disposed within said shell, and a compression mechanism is driven by said drive mechanism. A hermetic terminal assembly including a housing extends through said aperture and is surrounded by an annular flange including a leg portion. A projection on said leg portion having a thickness greater than said leg portion and secured to said inner surface of said shell.

A thickness of the projection may be approximately equal to a thickness of the housing. A ratio of a thickness of the projection compared to a thickness of the housing may be between 0.5-0.75. The housing may include a wall, and the wall and the leg portion may have a thickness that is less than a thickness of the projection. A ratio of a thickness of the projection compared to a thickness of the wall and the leg portion may be between 1.5-2.0. A ratio of a thickness of the projection compared to a thickness of the wall and the leg portion may be between 2.0-3.0. The projection may be secured to the inner surface approximately a shell thickness away from the aperture. The projection may be secured to the inner surface at least a shell thickness away from the aperture.

The wall may merge into the leg portion at a joint having a radius of curvature. Radii of the radius of curvature may have a length of about half a thickness of the wall or the leg portion.

A total length of the wall and the leg portion may be approximately four times a thickness of the wall or the leg portion.

The projection may be defined by sidewalls angled relative to the leg portion. The sidewalls may terminate at an apex portion that is substantially parallel to the leg portion.

A lip portion may be provided outboard the projection.

The present disclosure also provides a compressor including a shell having an inner surface and an outer surface that expand during operation of the compressor. An aperture may be formed in the shell, a drive mechanism may be disposed within the shell, and a compression mechanism is driven by the drive mechanism. A hermetic terminal assembly includes a housing that extends through the aperture and an annular flange surrounds the housing. A projection is secured to the inner surface of the shell a distance away from the aperture, and a flexible joint may connect the housing and the projection.

A thickness of the projection may be approximately equal to a thickness of the housing. A ratio of a thickness of the projection compared to a thickness of the housing may be between 0.5-0.75.

The flexible joint may include a wall and a leg portion and the, wall and the leg portion may have a thickness that is less than a thickness of the housing. A ratio of a thickness of the projection compared to a thickness of the wall and the leg portion may be between 1.5-2.0. A ratio of a thickness of the projection compared to a thickness of the wall and the leg portion may be between 2.0-3.0.

The distance may be approximately a shell thickness away from the aperture. The distance may be at least a shell thickness away from the aperture.

The joint may have a radius of curvature. Radii of the radius of curvature may have a length of about half a thickness of the wall or the leg portion.

A total length of the wall and the leg portion may be a minimum of four times a thickness of the wall or the leg portion.

The projection may be defined by sidewalls angled relative to the leg portion. The sidewalls may terminate at an apex portion that is substantially parallel to the leg portion.

A lip portion may be provided radially outward the projection.

The present disclosure also provides a compressor comprising a shell having an inner surface and an outer surface, and an aperture formed in the shell. A drive mechanism is disposed within the shell, and a compression mechanism is driven by the drive mechanism. A hermetic terminal assembly provided in the aperture may include a housing, an annular flange surrounding the housing, and a projection proximate an end of the annular flange that is welded to the inner surface. A lip portion may be provided radially outward the projection.

A thickness of the projection may be about equal to a thickness of the housing. A ratio of a thickness of the projection compared to a thickness of the housing may be between 0.5-0.75.

The housing may include a wall and a leg portion, and the wall and the leg portion may have a thickness that is less than a thickness of the housing. A ratio of a thickness of the projection compared to a thickness of the wall and the leg portion may be between 1.5-2.0. A ratio of a thickness of the projection compared to a thickness of the wall and the leg portion may be between 2.0-3.0.

The projection may be welded to the inner surface approximately a shell thickness away from the aperture. The projection may be welded to the inner surface at least a shell thickness away from the aperture.

The wall may merge into the leg portion at a joint having a radius of curvature. Radii of the radius of curvature may have a length of about half a thickness of the wall or the leg portion.

A total length of the wall and the leg portion may be a minimum of four times a thickness of the wall or the leg portion.

The projection may be defined by sidewalls angled relative to the annular flange. The sidewalls may terminate at an apex portion that is substantially parallel to the annular flange.

The lip portion may be adapted to catch molten metal during welding of the projection to the inner surface.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
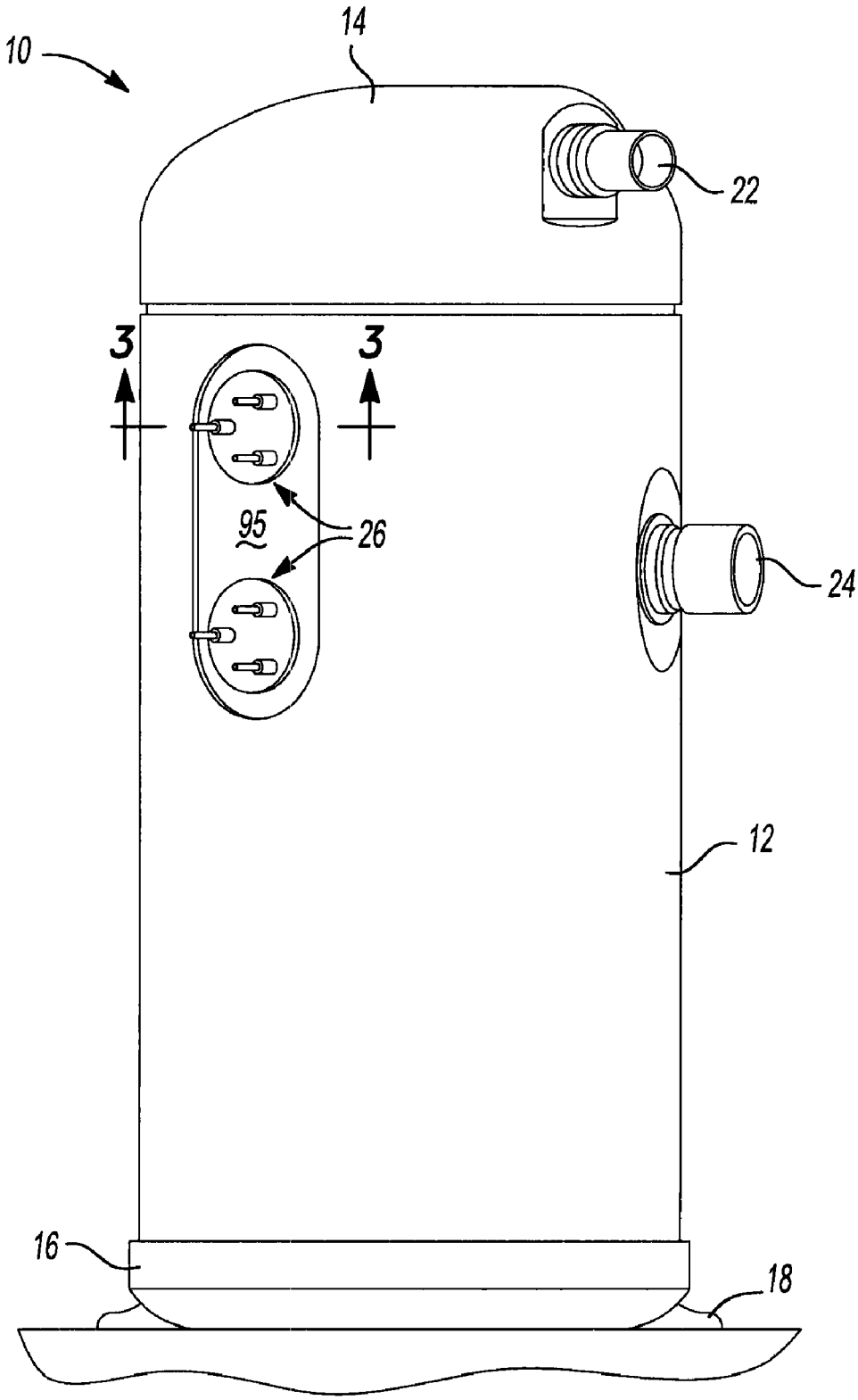
FIG. 1 is a perspective view of an exemplary compressor including a pair of hermetic terminals.

The following description is merely exemplary in nature and is not intended to limit the present disclosure, application, or uses. It should be understood that throughout the drawings, corresponding reference numerals indicate like or corresponding parts and features.

Figure 2:
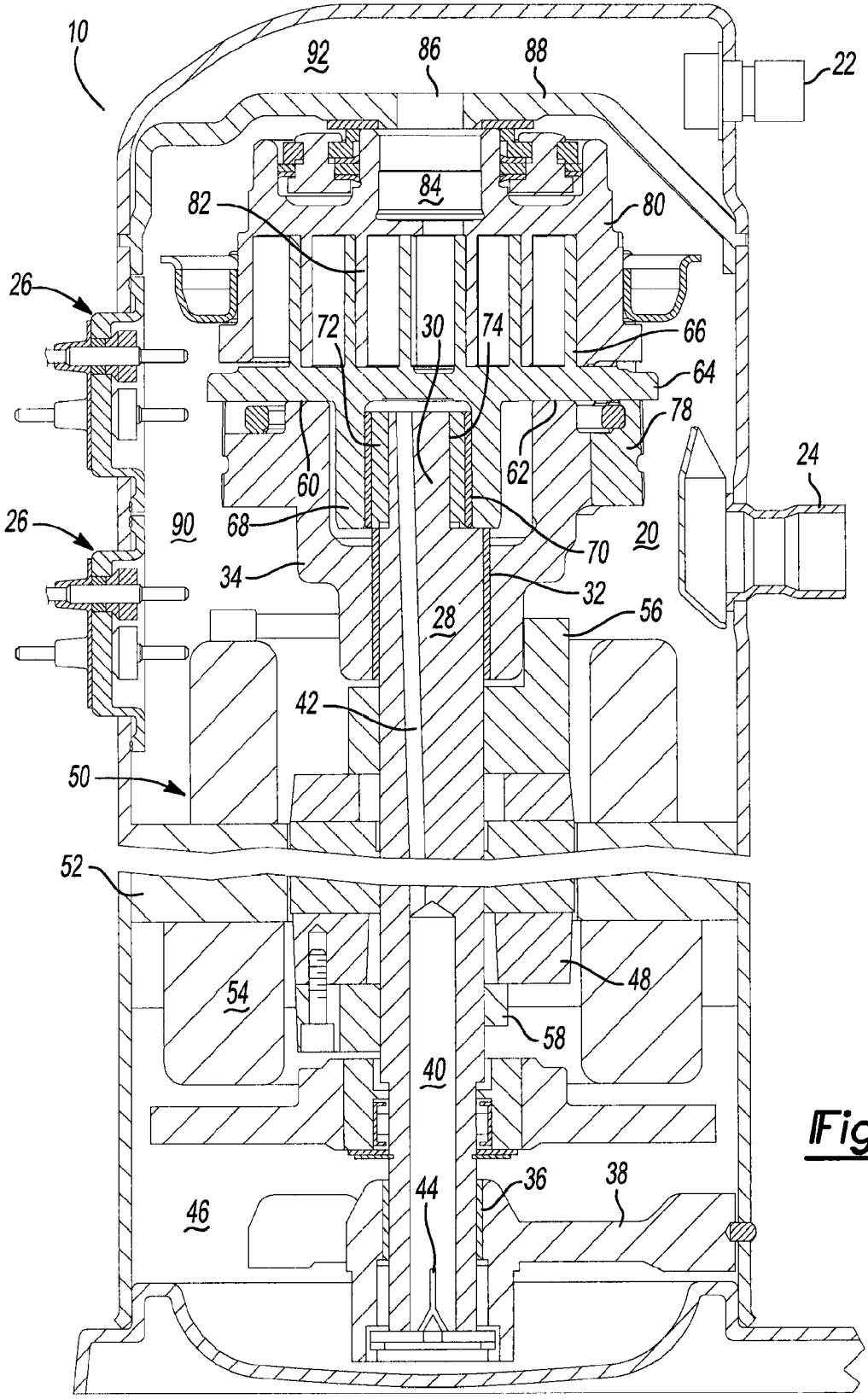
FIG. 2 is a cross-sectional view of the compressor shown in FIG. 1.

With particular reference to FIGS. 1 and 2, a compressor 10 is shown to include a hermetic shell 12 having a welded cap 14 at a top portion and a base 16 having a plurality of feet 18 welded at a bottom portion. Cap 14 and base 16 may be fitted to shell 12 such that an interior volume 20 of compressor 10 is defined. Cap 14 may be provided with a discharge fitting 22 and an inlet fitting 24 may be disposed generally between cap 14 and base 16. A single or plurality of hermetic terminals 26 may be disposed on a side of compressor shell 12.

A drive shaft or crankshaft 28 having an eccentric pin 30 at an upper end thereof is rotatably journaled in a bearing 32 in the main bearing housing 34. A second bearing 36 is disposed in the lower bearing housing 38. The crankshaft 28 has a relatively large diameter concentric bore 40 which communicates with a radially outwardly inclined smaller diameter bore 42 that extends to the end of the crankshaft 28. A stirrer 44 may be disposed within the bore 40. The lower portion of the interior shell 12 defines an oil sump 46 that may be filled with lubricating oil to a level slightly below the lower end of the rotor 48, and the bore 40 may act as a pump to pump lubricating fluid into the smaller diameter bore 42 and ultimately to all of the various portions of the compressor 10 which may require lubrication.

The crankshaft 28 may be rotatively driven by an electric motor 50 including a stator 52 and windings 54 passing therethrough. The rotor 48 may be press fitted on the crankshaft 28 and may have upper and lower counterweights 56 and 58, respectively.

An upper surface 60 of the main bearing housing 34 may be provided with a flat thrust bearing surface 62 on which an orbiting scroll member 64 may be disposed having the usual spiral vane or wrap 66 on the upper surface thereof. A cylindrical hub 68 may downwardly project from the lower surface of orbiting scroll member 64 which has a journal bearing 70 and drive bushing 72.

Crank pin 30 may have a flat 74 on one surface that drivingly engages a flat surface formed in a portion of the drive bushing 72 to provide a radially compliant driving arrangement. An Oldham coupling 78 may be provided positioned between the orbiting scroll member 64 and the main bearing housing 34 and may be keyed to the orbiting scroll member 64 and a non-orbiting scroll member 80 to prevent rotational movement of the orbiting scroll member 64.

Non-orbiting scroll member 80 also includes a wrap 82 positioned in meshing engagement with the wrap 66 of the orbiting scroll member 64. Non-orbiting scroll member 80 may have a centrally disposed discharge passage 84, which communicates with an upwardly open recess 86 formed in a partition 88 that separates the interior volume 20 of the compressor 10 into a suction chamber 90 and a discharge chamber 92. Recess 86 may be in fluid communication with discharge fitting 22 such that a compressed fluid exits compressor 10.

Figure 3:
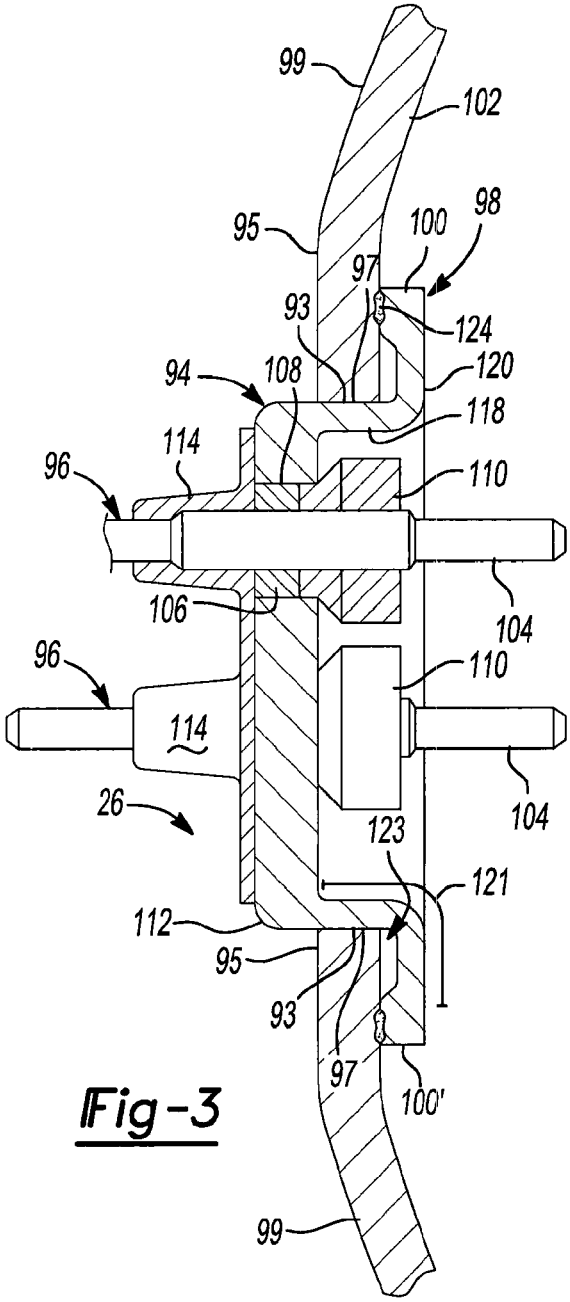
FIG. 3 is a cross-sectional view of hermetic terminal according to the present disclosure along line 3-3 in FIG. 1.

Now referring to FIG. 3, hermetic terminal assemblies 26 are generally disposed in aperture 93 formed in compressor shell 12. Aperture 93 may be defined by a peripheral surface 97 that extends between an outer surface 99 of shell 12 and an inner surface 102 of shell 12. Terminal assemblies 26 provide an electrical pathway for compressor 10, and may be electrically connected to motor 50 or sensors (not shown). Exemplary sensors include motor-based sensors, oil level sensors, pressure sensors, temperature sensors, and the like. Regardless, any electrical component within compressor 10 that may require an electrical connection may be in communication with terminal assemblies 26.

Terminal assemblies 26 generally include a cup-shaped housing 94 that houses a plurality of terminals 96. Cup-shaped housing 94 extends through aperture 93 along peripheral surface 97. Surrounding cup-shaped housing 94 may be an annular flange 98 that may be integral with cup-shaped housing 94. Cup-shaped housing 94 and flange 98 may be formed of steel or some other rigid material so that ends 100 of annular flange 98 may be welded to an inner surface 102 of compressor shell 12. To ensure a proper weld and hermetic seal between terminal assemblies 26 and shell 12, shell 12 may be provided with a surface 95 that is coined flat. Flat surface 95 provides a surface that better aligns with annular flange 98.

Each terminal 96 of hermetic terminal assembly 26 may include a stainless steel inner core 104 that passes through cup-shaped housing 94. A first or primary insulating member 106 that may be formed of, for example, glass seals a through 108 hole in cup-shaped housing 94 through which terminals 96 pass. Formed inside cup-shaped member (i.e., on a side of terminal assembly 26 adjacent interior volume 20) is a second or secondary insulating material 110 that may be formed of, for example, a ceramic material. An outer surface 112 of the cup-shaped housing 94 may be at least partially covered by a rubber membrane 114.

In FIG. 3, annular flange 98 extends generally perpendicular to walls 118 of cup-shaped housing 94. By welding annular flange 98 to inner surface of shell 12, the strength of the hermetic seal between terminal assembly 26 and shell 12 may be enhanced. In particular, the joint between aperture 93 and terminal assembly 26 may create a weakness in the overall strength of compressor shell 12 due to localized bending caused by discontinuity of the joint. Pressure within compressor 10 fluctuates to a great extent during operation. Pressure increases may cause shell 12 to expand in both axially and radially during operation of compressor 10. Simultaneously, aperture 93 may expand axially and radially.

Figure 4:
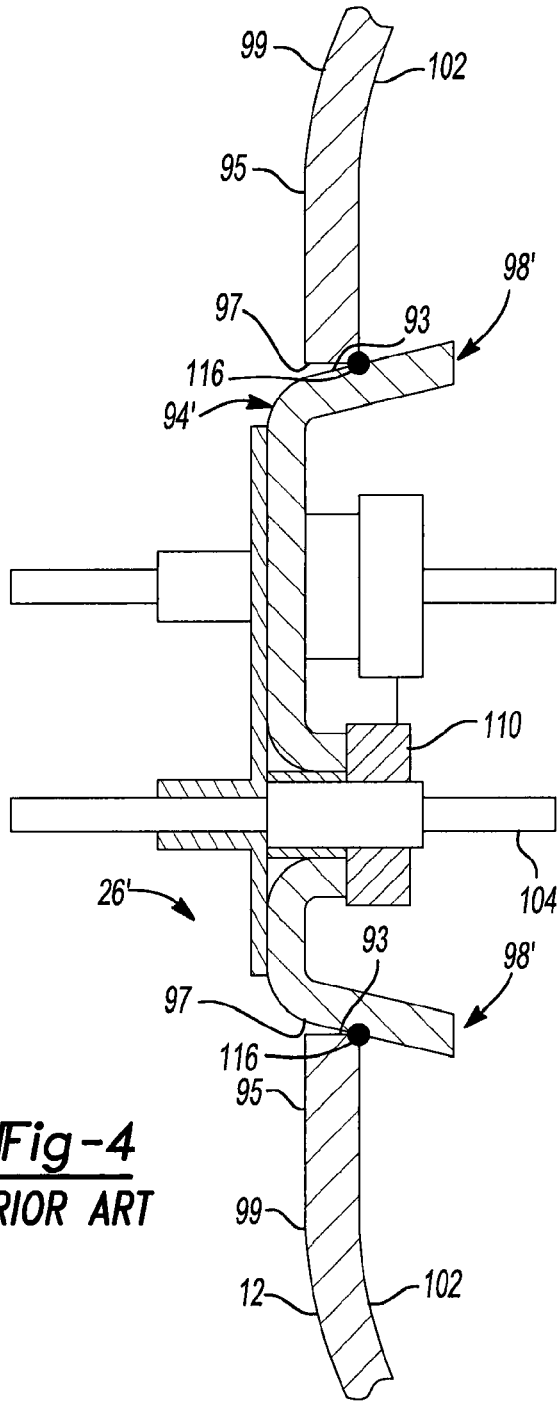
Fig-4 PRIOR ART
FIG. 4 is a cross-sectional view of a conventional hermetic terminal.

In a traditional design, shown in FIG. 4, terminal 26' may include a cup-shaped housing 94' extends through aperture 93 along peripheral surface 97. Surrounding cup-shaped housing 94' may be an annular flange 98' that may be integral with cup-shaped housing 94 and angled outwardly therefrom. Cup-shaped housing 94' and flange 98' may be formed of steel or some other rigid material so that annular flange 98' may be welded to a peripheral surface 97 of compressor shell 12 by weld line 116.

Referring to FIG. 4, weld line 116 between shell 12 and terminal assembly 26' is located at the edge of the aperture 93 between outer surface 99 of shell 12 and peripheral surface 97. During expansion of shell 12, high localized stress and strain concentration may be experienced at weld line 116. Under pressure, the weld may bend like a hinge, which may cause fatigue cracks to develop in weld joint at the notch where shell aperture 93, terminal housing 94', and weld 116 meet. Fatigue cracks may propagate through shell 12, or the wall of terminal housing 94', which may cause loss of the hermetic seal and failure of the compressor 10.

Referring again to FIG. 3, welding annular flange 98 to inner surface of shell 12 increases the compliance of cup-shaped housing 94 during radial and axial expansion of shell 12. When shell 12 expands axially and radially, annular flange 98 will also be pulled axially and radially along with the expansion. Furthermore, because weld line 124 is formed at a distance from aperture 93, stress is not localized on weld line 124. The fatigue strength of the weld 124, therefore, may be increased and failure of the hermetic seal between terminal assembly 26 and shell 12 may be prevented, or at least substantially minimized. Furthermore, a thickness of shell 12 may be kept at a minimum, which reduces material and manufacturing costs.

Cup-shaped housing 94 may include walls 118 and leg portions 120 of annular flange 98 that include a thickness that is less than that of cup-shaped housing 94. The reduced thickness of walls 118 and leg portions 120 may enhance the compliance of the cup-shaped housing 94 to conform to the shell deflection during operation of compressor 10.

The reduced thickness walls 118 and leg portions 120 may deform as shell 12 and aperture 93 expand axially and radially. A thickness of walls 118 and leg portions 120 may be less than one-half a thickness of shell 12. A total cross-sectional centerline length 121 of walls 118 and leg portions 120 may be a minimum of four times the thickness of walls 118 and leg portions 120, which may provide a sufficient material volume to distribute movement. The thickness and cross-sectional length 121, however, may be optimized by utilizing Finite Element Analysis (FEA) during design of the compressor shell 12. FEA is a diagnostic tool that measures and displays stress and strain that may be experienced by shell 12 during operation of compressor 10. Using FEA, a thickness and length of walls 118 and leg portions 120 may be selected depending on the magnitude of stress and strain exhibited at weld 124 during operation of compressor 10.

Walls 118 merge into leg portions 120 through a radius of curvature 123. Radii of curvature 123 may be larger than half a thickness of walls 118 and leg portions 120. Providing a radius of curvature 123 between walls 118 and leg portions 120 may improve stress concentrations, and a larger radius of curvature 123 may provide lower stresses because a sharp curve between walls 118 and leg portions 120 may tend to yield to fatigue during operation of compressor 10.

Ends 100 of leg portions 120 of annular flange 98 may have a thickness about or equal to a thickness of cup-shaped housing 94. Alternatively, ends 100 of leg portions 120 of annular flange 98 may have a thickness less than a thickness of cup-shaped housing 94, but greater than a thickness of walls 118 and leg portions 120. In this regard, a ratio of a thickness of ends 100 compared to a thickness of cup-shaped housing 94 may be between 0.50 and 0.75. A ratio of a thickness of ends 100 compared a thickness of walls 118 and leg portions 120 may be between 1.50 and 2.0. Ends 100 having a thickness greater than walls 118 and leg portions 120 provide for a projection-style resistance weld 124. Projection-style resistance weld 124 may enhance a bonding strength between terminal assembly 26 and shell 12, and may provide stiffness to annular flange 98. End 100 may be located a minimum of a shell thickness away from an edge of aperture 93. Ends 100, however, may be provided at an even greater distance to further allow larger deformation of walls 118 and leg portions 120 during operation of compressor 10.

Figure 5A:
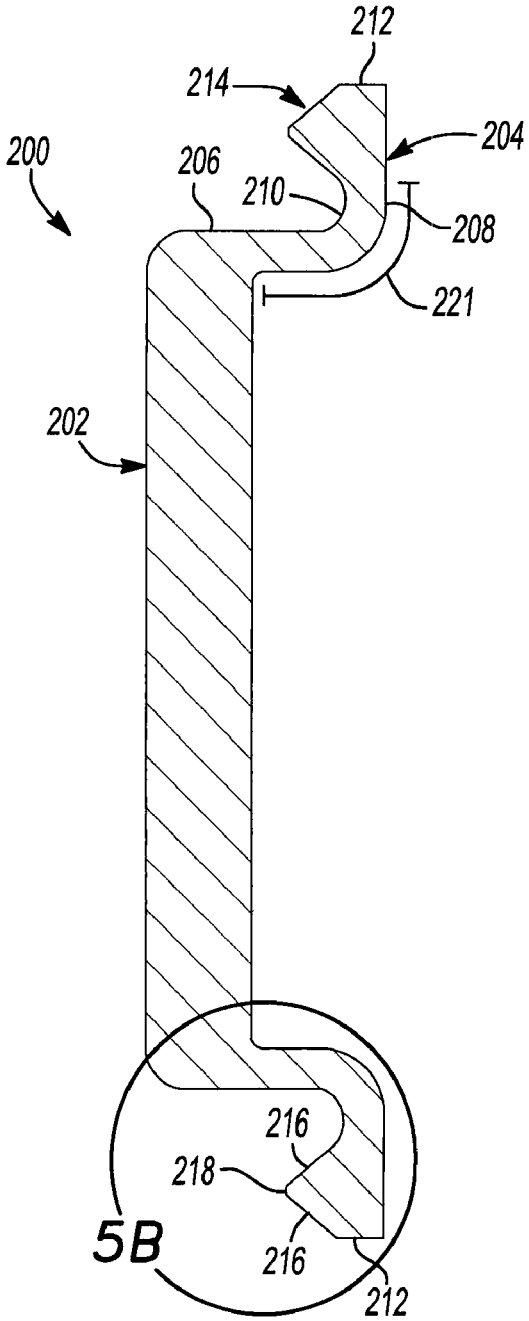
FIGS. 5A and 5B are cross-sectional views of the hermetic terminal according to the present disclosure.
Figure 5B:
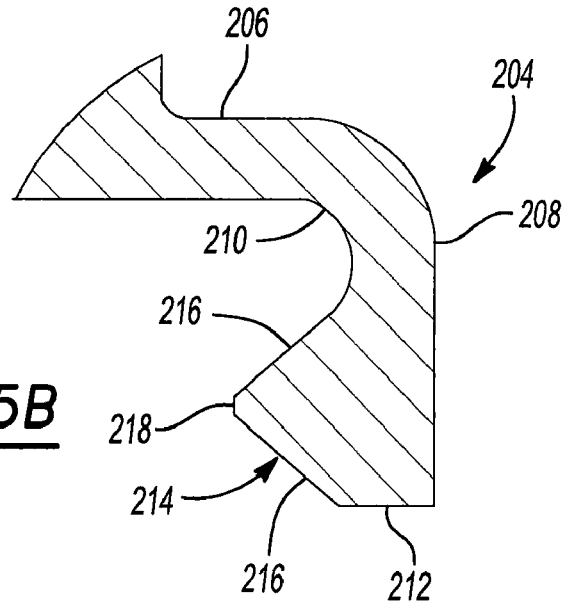

In FIGS. 5A and 5B, hermetic terminal 200 includes a cup-shaped housing 202 having an annular flange 204. Similar to terminal 26, cup-shaped housing 202 may include walls 206 and leg portions 208 of annular flange 204 that include a thickness that is less than that of cup-shaped housing 202. The reduced thickness of walls 206 and leg portions 208 may enhance the elasticity of the cup-shaped housing 202 to permit flex and compliance during operation of compressor 10.

Walls 206 may also merge into leg portions 208 through a radius of curvature 210. Radii of curvature 210 may be larger than half of a thickness of walls 206 and leg portions 208. Providing a radius of curvature 210 between walls 206 and leg portions 208 may improve stress concentrations, and a larger radius of curvature 210 may provide lower stresses because a sharp curve between walls 206 and leg portions 208 may tend to yield to fatigue during operation of compressor 10. A total cross-sectional centerline length 221 of walls 206 and leg portions 208 may be a minimum of four times the thickness of walls 206 and leg portions 208, which may provide a sufficient material volume to distribute movement. The thickness and cross-sectional length 221, however, may be optimized by utilizing Finite Element Analysis (FEA) during design of the compressor shell 12.

Ends 212 of leg portions 208 of annular flange 204 may be provided with a projection 214. Projection 214 may include a pair of sidewalls 216 that are acutely angled relative to leg portion 208. Sidewalls 216 terminate at apex portion 218, which provides a flat surface that may be substantially parallel to leg portion 208. Apex portion 218 provides a smaller contact area between shell 12 and annular flange 204. The smaller contact area provided by apex portion 218 may enable higher current density that may allow the weld to start at a lower current. Although, if the contact area is too small it will result in an unsuccessful weld because the current density is too high and would create a fuse effect Projection 214 may have a thickness about or equal to a thickness of cup-shaped housing 202. A ratio of a thickness of projection 214 compared to a thickness of walls 206 and leg portions 208 may be between 2.0 and 3.0 This provides for a projection-style resistance weld (not shown) that may enhance a bonding strength between the terminal and shell, and may provide stiffness to annular flange 204. End 212 may be located a minimum of a shell thickness away from an edge of aperture 93. Ends 212, however, may be provided at an even greater distance to further allow larger deformation of walls 206 and leg portions 208 during operation of compressor 10.

Figure 6A:
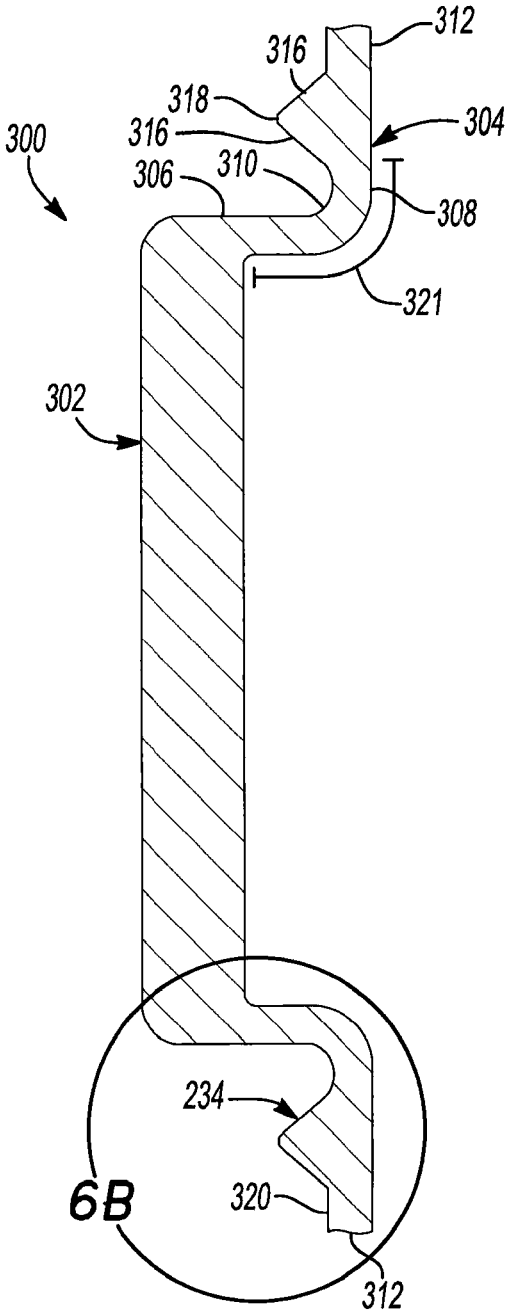
FIGS. 6A and 6B are cross-sectional views of the hermetic terminal according to the present disclosure.
Figure 6B:
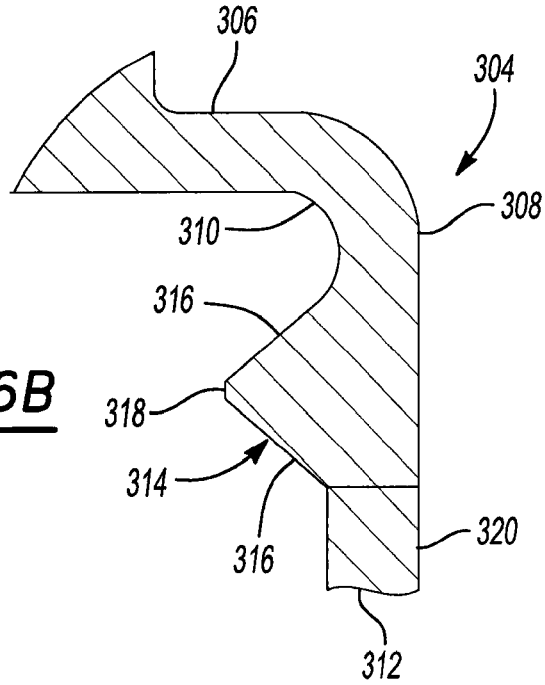

FIGS. 6A and 6B illustrate a hermetic terminal 300 that is similar to hermetic terminal 200 shown in FIGS. 5A and 5B. Terminal 300 includes a cup-shaped housing 302 having an annular flange 304. Similar to terminal 200, cup-shaped housing 302 may include walls 306 and leg portions 308 of annular flange 304 that include a thickness that is less than that of cup-shaped housing 302. The reduced thickness of walls 306 and leg portions 308 may enhance the elasticity of the cup-shaped housing 302 to permit flex and compliance during operation of compressor 10.

Walls 306 may also merge into leg portions 308 through a radius of curvature 310. Radii of curvature 310 may be larger than half of a thickness of walls 306 and leg portions 308. Providing a radius of curvature 310 between walls 306 and leg portions 308 may improve stress concentrations, and a larger radius of curvature 310 may provide lower stresses because a sharp curve between walls 306 and leg portions 308 may tend to yield to fatigue during operation of compressor 10. A total cross-sectional centerline length 321 of walls 306 and leg portions 308 may be a minimum of four times the thickness of walls 306 and leg portions 308, which may provide a sufficient material volume to distribute movement. The thickness and cross-sectional length 321, however, may be optimized by utilizing Finite Element Analysis (FEA) during design of the compressor shell 12.

Ends 312 of leg portions 308 of annular flange 304 may be provided with a projection 314. Projection 314 may include a pair of sidewalls 316 that are acutely angled relative to leg portion 308. Sidewalls 316 terminate at apex portion 318, which provides a flat surface that may be substantially parallel to leg portion 308. Apex portion 318 provides a smaller contact area between shell 12 and annular flange 304. The smaller contact area provided by apex portion 318 may enable higher current density that may allow the weld to start at a lower current. After projection 314, end 312 continues to extend radially outward such that leg portion 308 is provided with a radially outwardly extending portion or lip 320. Lip 320 may allow for better contact with a welding electrode (not shown) that conducts a current through annular flange 308. Lip 320 also assists in catching molten metal produced during welding to provide a more robust weld between terminal 300 and shell 12.

Similar to terminal 200, projection 314 may have a thickness about or equal to a thickness of cup-shaped housing 302. A ratio of a thickness of projection 314 compared to a thickness of walls 306 and leg portions 308 may be between 2.0 and 3.0. Projection 314 having a thickness about or equal to cup-shaped housing 302 may provide for a projection-style resistance weld (not shown) that may enhance a bonding strength between terminal assembly 300 and shell 12, and may provide stiffness to annular flange 304. End 312 may be located a minimum of a shell thickness away from an edge of aperture 93. Ends 312, however, may be provided at an even greater distance to further allow larger deformation of walls 306 and leg portions 308 during operation of compressor 10.

The above description is merely exemplary in nature and, thus, variations that do not depart from the gist of the present teachings are intended to be within the scope of the present teachings. Such variations are not to be regarded as a departure from the spirit and scope of the present teachings.

For example, it should be understood that although the above configurations have been described relative to use in a scroll compressor, the present teachings should not be limited to a scroll compressor. In contrast, the hermetic terminals described above can be configured and adapted to operate with any type of compressor known to one skilled in the art, including rotating, orbiting, and reciprocating types. Further, although the present teachings have been described relative to a hermetic terminal for a compressor, the hermetic terminals may be adapted for use with any apparatus or device that requires an hermetically sealed structure without departing from the spirit and scope of the present teachings.

What is claimed is:

1. A compressor comprising:

a shell having an inner surface and an outer surface;

an aperture in said shell;

a drive mechanism disposed within said shell;

a compression mechanism driven by said drive mechanism;

a hermetic terminal assembly including a housing extending through said aperture and surrounded by an annular flange including a leg portion;

a projection on said leg portion having a thickness greater than said leg portion and secured to said inner surface of said shell.

2. The compressor of claim 1, wherein a thickness of said projection is approximately equal to a thickness of said housing.

3. The compressor of claim 1, wherein a ratio of a thickness of said projection compared to a thickness of said housing is between 0.5-0.75.

4. The compressor of claim 1, wherein said housing includes a wall, said wall and said leg portion having a thickness that is less than a thickness of said projection.

5. The compressor of claim 4, wherein a ratio of a thickness of said projection compared to a thickness of said wall and said leg portion is between 1.5-2.0.

6. The compressor of claim 4, wherein a ratio of a thickness of said projection compared to a thickness of said wall and said leg portion is between 2.0-3.0.

7. The compressor of claim 1, wherein said projection is secured to said inner surface approximately a shell thickness away from said aperture.

8. The compressor of claim 1, wherein said projection is secured to said inner surface at least a shell thickness away from said aperture.

9. A compressor comprising:

a shell having an inner surface and an outer surface;

an aperture formed in said shell;

a drive mechanism disposed within said shell;

a compression mechanism driven by said drive mechanism; and a hermetic terminal assembly including a housing extending through said aperture and an annular flange surrounding said housing, said annular flange including a projection secured to said inner surface of said shell a distance away from said aperture and a leg portion connecting said projection to said housing.

10. The compressor of claim 9, wherein a thickness of said projection is approximately equal to a thickness of said housing.

11. The compressor of claim 9, wherein a ratio of a thickness of said projection compared to a thickness of said housing is between 0.5-0.75.

12. The compressor of claim 9, wherein said leg portion includes a thickness that is less than a thickness of said housing.

13. The compressor of claim 12, wherein a ratio of a thickness of said projection compared to a thickness of said leg portion is between 1.5-2.0.

14. The compressor of claim 12, wherein a ratio of a thickness of said projection compared to a thickness of said leg portion is between 2.0-3.0.

15. The compressor of claim 9, wherein said distance is approximately a shell thickness away from said aperture.

16. The compressor of claim 9, wherein said projection is secured to said inner surface at least a shell thickness away from said aperture.

17. The compressor of claim 9, further comprising a lip portion provided radially outward said projection.

18. A compressor comprising:

a shell having an inner surface and an outer surface;

an aperture formed in said shell;

a drive mechanism disposed within said shell;

a compression mechanism driven by said drive mechanism;

a hermetic terminal assembly provided in said aperture and including a housing; and an annular flange attached to and surrounding said housing, said annular flange including a leg portion having an area of increased thickness.

19. The compressor of claim 18, wherein a thickness of said leg portion at said area of increased thickness is approximately equal to a thickness of said housing.

20. The compressor of claim 18, wherein a ratio of a thickness of said area of increased thickness compared to a thickness of said housing is between 0.5-0.75.

21. The compressor of claim 18, wherein said leg portion includes a thickness that is less than a thickness of said housing at a location extending between said housing and said area of increased thickness.

22. The compressor of claim 18, wherein a ratio of a thickness of said area of increased thickness compared to a thickness of said leg portion is between 1.5-2.0.

23. The compressor of claim 18, wherein a ratio of a thickness of said area of increased thickness compared to a thickness of said leg portion is between 2.0-3.0.

24. The compressor of claim 18, wherein said area of increased thickness is welded to said inner surface approximately a shell thickness away from said aperture.

25. The compressor of claim 18, wherein said area of increased thickness is secured to said inner surface at least a shell thickness away from said aperture.

26. The compressor of claim 18, further comprising a lip portion provided radially outward said area of increased thickness.

* * * * *

UNITED STATES PATENT AND TRADEMARK OFFICE

CERTIFICATE OF CORRECTION

PATENT NO. : 8,262,372 B2
APPLICATION NO. : 12/115651
DATED : September 11, 2012
INVENTOR(S) : Zhichao Wang et al.

It is certified that error appears in the above-identified patent and that said Letters Patent is hereby corrected as shown below:

| | |
|---|---|
| Column 2, Line 19 | "the, wall" should be --the wall--. |
| Column 5, Line 3 | After "expand" delete "in". |
| Column 5, Line 7 | "extends" should be --extending--. |
| Column 6, Line 58 | After "effect" insert --.--. |

Signed and Sealed this
Fifth Day of February, 2013

Teresa Stanek Rea
*Acting Director of the United States Patent and Trademark Office*